US011835186B2

(12) United States Patent
Wang

(10) Patent No.: US 11,835,186 B2
(45) Date of Patent: Dec. 5, 2023

(54) WATERPROOF BULB WITH HORIZONTALLY MOUNTED PCB

(71) Applicant: DONGGUAN HUIHUAN LIGHTING CO., LTD, Dongguan (CN)

(72) Inventor: Song Wang, Chengdu (CN)

(73) Assignee: DONGGUAN HUIHUAN LIGHTING CO., LTD, Dongguan (CN)

( * ) Notice: Subject to any disclaimer, the term of this patent is extended or adjusted under 35 U.S.C. 154(b) by 0 days.

(21) Appl. No.: 18/110,392

(22) Filed: Feb. 16, 2023

(65) Prior Publication Data

US 2023/0194056 A1 Jun. 22, 2023

(30) Foreign Application Priority Data

Oct. 26, 2022 (CN) ..... 202222828002.2

(51) Int. Cl.

| | |
|---|---|
| ***F21K 9/237*** | (2016.01) |
| ***F21K 9/238*** | (2016.01) |
| ***F21V 31/00*** | (2006.01) |
| ***F21K 9/232*** | (2016.01) |

(52) U.S. Cl.

CPC ..... *F21K 9/237* (2016.08); *F21K 9/232* (2016.08); *F21K 9/238* (2016.08); *F21V 31/005* (2013.01)

(58) Field of Classification Search

CPC ..... F21K 9/237; F21K 9/232; F21K 9/238

See application file for complete search history.

(56) References Cited

U.S. PATENT DOCUMENTS

| | | | | |
|---|---|---|---|---|
| 11,125,430 | B1 * | 9/2021 | Wu | F21V 17/12 |
| 2012/0235586 | A1 | 9/2012 | Lenk | |
| 2018/0156445 | A1 | 6/2018 | Chen | |
| 2022/0260244 | A1 | 8/2022 | Selak | |

FOREIGN PATENT DOCUMENTS

CN 206419687 U * 8/2017

* cited by examiner

*Primary Examiner* — Karabi Guharay

(74) *Attorney, Agent, or Firm* — Zhigang Ma

(57) ABSTRACT

The present disclosure relates to the technical field of lamps and provides a waterproof bulb with a horizontally mounted PCB. The waterproof bulb with the horizontally mounted PCB includes a lamp holder and a bulb shell connected to the lamp holder, and further includes a core column structure, which is disposed inside the bulb shell. The core column structure includes a sealing base with sealing and waterproof actions, and a first conductive support strip, a PCB circuit board and a second conductive support strip that are successively connected.

5 Claims, 5 Drawing Sheets

WATERPROOF BULB WITH HORIZONTALLY MOUNTED PCB

TECHNICAL FIELD

The present disclosure relates to the technical field of lamps, in particular to a waterproof bulb with a horizontally mounted PCB (Printed Circuit Board).

BACKGROUND

With the popularization of electricity, lamps have entered thousands of households. People are no longer limited to ordinary lighting with the lamps, and more inclined to create different atmospheres through the lamps. For example, when at a party, bulbs with different light-emitting colors are made into light strings, and fixed in places, such as artificial trees, walls, fences and tops of interior ceilings, so as to heighten a party atmosphere and add an artistic effect, etc.

There are many kinds of bulbs for decoration on the market, however the traditional bulb still has some deficiencies, for example, the bulb has a poor waterproof property, and is easily affected by an external environment during use. When in rainy days or the water is incautiously and artificially sprayed to the bulb, the bulb is prone to damage or mist generated inside the bulb is caused, thereby affecting the decoration effect and not meeting demands of users. For this reason, the inventor creates a new invention.

SUMMARY

Aiming at the deficiencies in the prior art, the present disclosure provides a waterproof bulb with a horizontally mounted PCB, which has a characteristic of good waterproof property.

In order to implement the above purpose, a waterproof bulb with a horizontally mounted PCB provided by the present disclosure includes a lamp holder and a bulb shell connected to the lamp holder. The waterproof bulb with the horizontally mounted PCB further includes a core column structure, which is disposed inside the bulb shell; the core column structure includes a sealing base with sealing and waterproof actions, and a first conductive support strip, a PCB circuit board and a second conductive support strip that are successively connected. The PCB circuit board is horizontally arranged, and at least one LED (Light-emitting Diode) lamp bead is disposed on an upper surface of the PCB circuit board. The PCB circuit board is also provided with an IC (Integrated Circuit) controller, the first conductive support strip and the other end of the second conductive support strip are all connected to the lamp holder electrically, the sealing base fits with an opening portion of the bulb shell tightly, and the sealing base is provided with at least two containing holes, through which the two conductive support strips can pass.

Preferably, the containing holes may be blind holes punctured through the conductive support strips.

Preferably, the first conductive support strip is connected to a resistor a, the second conductive support strip is connected to a resistor b, and the resistor a and the resistor b are all installed in the containing holes tightly.

Preferably, the IC controller is disposed at a bottom of the PCB circuit board.

Further, the IC controller is electrically connected to the LED lamp bead.

Further, the sealing base includes a cylindrical portion for sealing and waterproofing, an upper part of the cylindrical portion is connected to a support portion, and a lower part of the cylindrical portion is provided with a flange.

Beneficial effects: compared with the prior art, the present disclosure provides the waterproof bulb with the horizontally mounted PCB, including the lamp holder and the bulb shell connected to the lamp holder. The waterproof bulb with the horizontally mounted PCB further includes the core column structure, which is disposed inside the bulb shell; the core column structure includes the sealing base with the sealing and waterproof actions, and the first conductive support strip, the PCB circuit board and the second conductive support strip that are successively connected. The PCB circuit board is horizontally arranged, and at least one LED lamp bead is disposed on the upper surface of the PCB circuit board. The waterproof bulb with the horizontally mounted PCB provided by the present disclosure has the following advantages: 1. The bulb is provided with the sealing base, which fits with the opening portion of the bulb shell tightly, so as to prevent water or moisture from entering inside the bulb shell, and the bulb has a better waterproof property; 2. The core column structure is made by the LED lamp bead inserted into the PCB board, so the bulb is more convenient and quicker to be assembled; and 3. The PCB board is horizontally arranged, and with 180 degrees of illumination, the spotlight effect may be formed.

REFERENCE SIGNS INCLUDE

Lamp holder—1, bulb shell—2, core column structure—3, sealing base—31, cylindrical portion—311, support portion—312, flange—313, first conductive support strip—32, resistor a—321, PCB circuit board—33, second conductive support strip—34, resistor b—341, LED lamp bead—4, IC controller—5, containing hole—51.

DETAILED DESCRIPTION OF THE EMBODIMENTS

Figure 1:
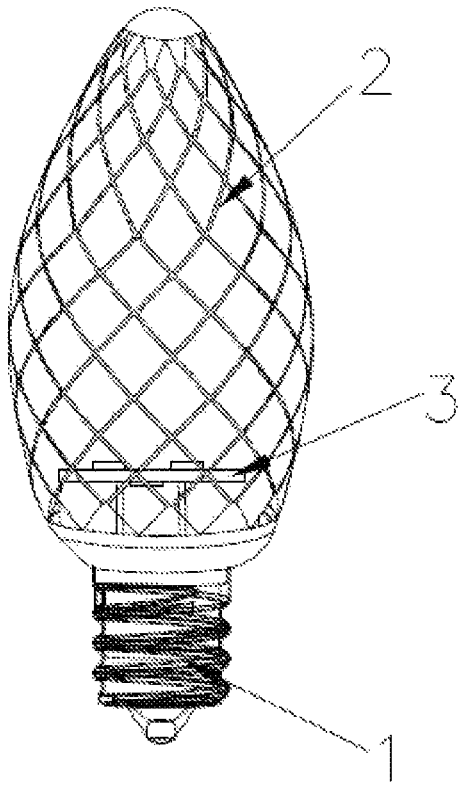
FIG. 1 is a solid schematic diagram of the present disclosure.
Figure 2:
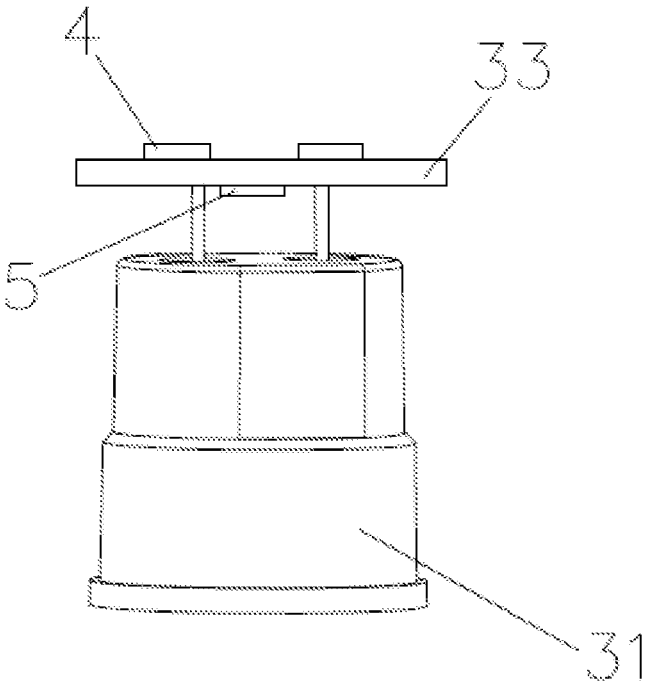
FIG. 2 is a structural schematic diagram of a core column structure of the present disclosure.
Figure 3:
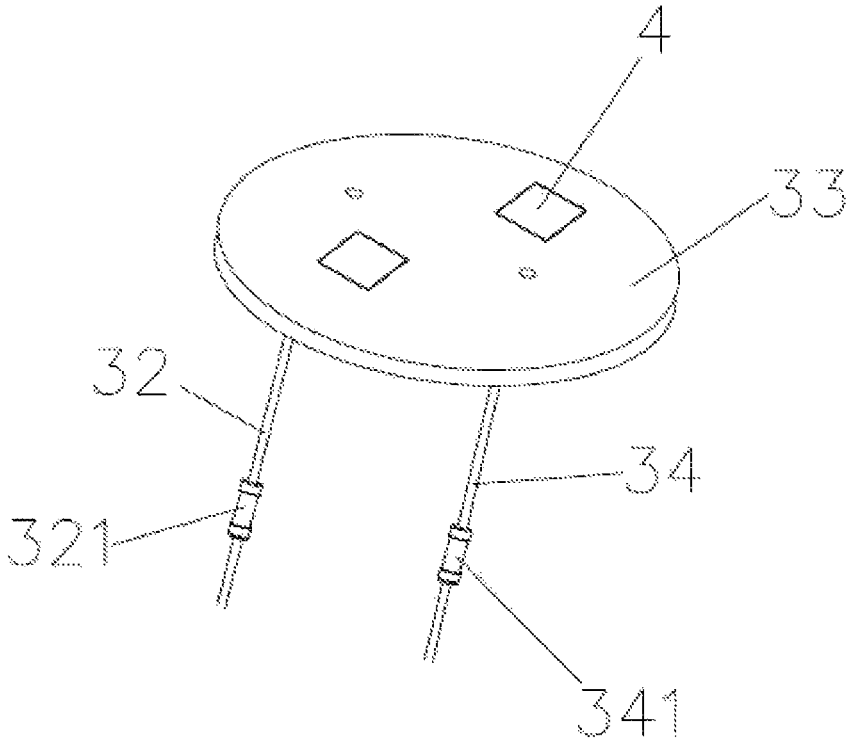
FIG. 3 is a structural schematic diagram of a PCB circuit board of the present disclosure.
Figure 4:
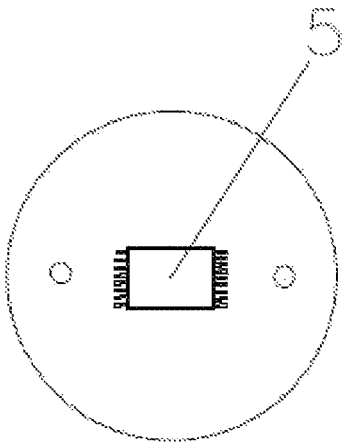
FIG. 4 is a structural schematic diagram of a bottom of a PCB circuit board of the present disclosure.
Figure 5:
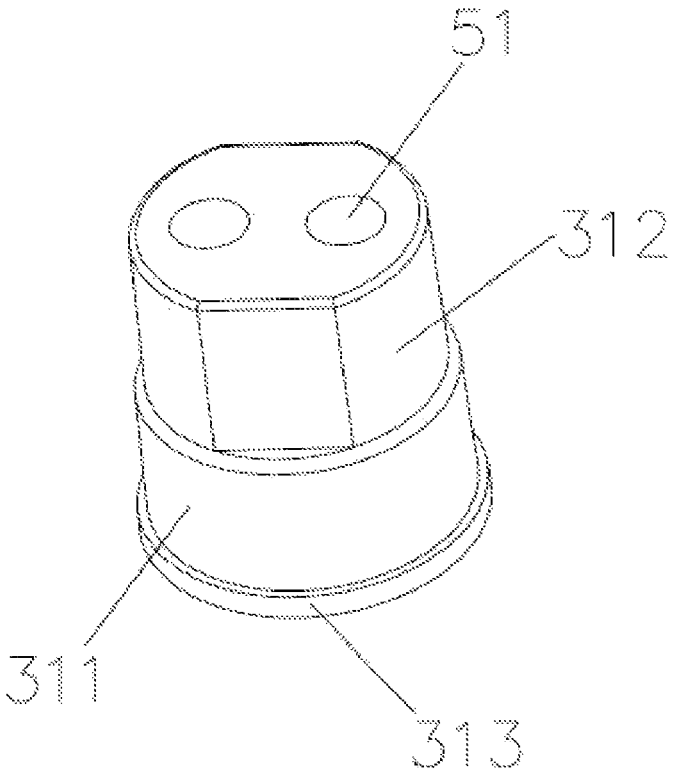
FIG. 5 is a structural schematic diagram of a sealing base of the present disclosure.

The present disclosure is further described in combination with FIG. 1 to FIG. 5 below.

The present disclosure provides a waterproof bulb with a horizontally mounted PCB, including a lamp holder 1 and a bulb shell 2 connected to the lamp holder 1. The waterproof bulb with the horizontally mounted PCB further includes a core column structure 3, which is disposed inside the bulb shell 2; the core column structure 3 includes a sealing base 31 with sealing and waterproof actions, and a first conductive support strip 32, a PCB circuit board 33 and a second conductive support strip 34 that are successively connected. The PCB circuit board 33 is horizontally arranged, and at least one LED lamp bead 4 is disposed on an upper surface of the PCB circuit board 33. The PCB circuit board 33 is also provided with an IC controller 5, the first conductive support strip 32 and the other end of the second conductive support strip 34 are all connected to the lamp holder 1 electrically, the sealing base 31 fits with an opening portion of the bulb shell 2 tightly, and the sealing base 31 is provided with at least two containing holes 51, through which the two conductive support strips can pass.

Compared with the traditional bulb, the waterproof bulb with the horizontally mounted PCB provided by the present disclosure has a better waterproof property, the sealing base 31 is disposed at the opening portion of the bulb shell 2 so as to prevent water from entering inside the bulb shell 2, thereby effectively improving the waterproof property of the bulb and prolonging the service life of the bulb. In addition, different from the traditional bulb structure, the core column structure 3 provided by the present disclosure adopts a manner that the LED lamp bead 4 is installed on the PCB circuit board 33 for lighting, and the PCB circuit board 33 is horizontally arranged, so that when the bulb is used, the illumination is 180 degrees, the spotlight effect may generate, and the decoration effect different from the traditional bulb is implemented. At the same time, the core column structure 3 adopted in the present disclosure is more convenient to assemble the bulb of different sizes. Due to a smaller size of the bulb shell 2 and a long and thin lamp wick, the traditional lamp core structure needs to be assembled carefully regardless of manual assembly or automatic assembly, and otherwise the lamp wick is easy to be broken. The core column structure 3 in the present disclosure may avoid the occurrence of this phenomenon well, and improve the production efficiency of the bulb.

Preferably, the containing holes 51 may be blind holes punctured through the conductive support strips. Bottoms of the containing holes 51 are sealed, which is conducive to preventing water, moisture and the like from entering inside the bulb shell 2 through the containing holes 51 and avoiding mist generated inside the bulb shell 2 during use, and the waterproof property of the bulb is further improved.

Preferably, the first conductive support strip 32 is connected to a resistor a 321, the second conductive support strip 34 is connected to a resistor b 341, and the resistor a 321 and the resistor b 341 are all installed in the containing holes 51 tightly. Positions of the resistor a 321 and the resistor b 341 are limited by using the containing holes 51, so as to avoid the resistor displacement affecting the use of the bulb. In this technical solution, the manner that the first conductive support strip 32 and the second conductive support strip 34 are provided with the resistor a 321 and the resistor b 341 is that the resistor a 321 and the resistor b 341 are plugged in middles of the first conductive support strip 32 and the second conductive support strip 34 or a connection between a lead and the lamp holder 1 is added after the first conductive support strip 32 is connected to the second conductive support strip 34. The actions of the resistor a 321 and the resistor b 341 are mainly to prevent from damaging the core column structure 3 when the bulb has a short circuit and a great current, thereby playing a current-limiting action; and when the bulb is continuously used and the conductive support strip has a higher temperature, the resistor a 321 and the resistor b 341 can also play a radiating action. In addition to this, the resistor a 321 and the resistor b 341 may also be integrated to the PCB circuit board 33 directly, thereby further simplifying the bulb structure.

In this technical solution, the inventor arranges the IC controller 5 at the bottom of the PCB circuit board 33, and the IC controller 5 is electrically connected to the LED lamp bead 4. The IC controller 5 is mainly configured to reduce the voltage of the LED lamp bead 4, stabilize the intensity of pressure of the LED lamp bead 4, and then the IC controller 5 has a rectifying action, so as to improve the stability of the bulb. However, the IC controller 5 is disposed at the bottom of the PCB board, which can not only simplify the core column structure 3 without additionally providing a component to assemble the IC controller 5, but also avoid affecting the lighting effect of the LED lamp bead 4 when the IC controller 5 is disposed on the upper surface of the PCB board.

As an embodiment, the sealing base 31 includes a cylindrical portion 311 for sealing and waterproofing, an upper part of the cylindrical portion 311 is connected to a support portion 312, and a lower part of the cylindrical portion 311 is provided with a flange 313. The cylindrical portion 311 and the opening portion of the bulb shell 2 are sealed, and the flange 313 is configured to cover the opening portion of the bulb shell 2, so as to strengthen the sealing.

The above content is only a preferred embodiment of the present disclosure, ordinary skill in the art may make changes based on the concept of the present disclosure within the scope of the specific embodiments and the application, therefore the content of the specification should not be understood as a limitation to the present disclosure.

What is claimed is:

1. A waterproof bulb with a horizontally mounted PCB, comprising a lamp holder (1) and a bulb shell (2) connected to the lamp holder (1), wherein the waterproof bulb with the horizontally mounted PCB further comprises a core column structure (3), which is disposed inside the bulb shell (2); the core column structure (3) comprises a sealing base (31) with sealing and waterproof actions, and a first conductive support strip (32), a PCB circuit board (33) and a second conductive support strip (34) that are successively connected; the PCB circuit board (33) is horizontally arranged, and at least one LED lamp bead (4) is disposed on an upper surface of the PCB circuit board (33); and the PCB circuit board (33) is also provided with an IC controller (5), the first conductive support strip (32) and the other end of the second conductive support strip (34) are all connected to the lamp holder (1) electrically, the sealing base (31) fits with an opening portion of the bulb shell (2) tightly, and the sealing base (31) is provided with at least two containing holes (51), through which the two conductive support strips pass into an inside of the sealing base (31); wherein the first conductive support strip (32) is connected to a resistor a (321), the second conductive support strip (34) is connected to a resistor b (341), and the resistor a (321) and the resistor b (341) are all installed in the containing holes (51) tightly.

2. The waterproof bulb with the horizontally mounted PCB according to claim 1, wherein the containing holes (51) are blind holes punctured through the conductive support strips.

3. The waterproof bulb with the horizontally mounted PCB according to claim 1, wherein the IC controller (5) is disposed at a bottom of the PCB circuit board (33).

4. The waterproof bulb with the horizontally mounted PCB according to claim 1, wherein the IC controller (5) is electrically connected to the LED lamp bead (4).

5. The waterproof bulb with the horizontally mounted PCB according to claim 1, wherein the sealing base (31) comprises a cylindrical portion (311) for sealing and waterproofing, an upper part of the cylindrical portion (311) is connected to a support portion (312) having a size less than the cylindrical portion (311), and a lower part of the cylindrical portion (311) is provided with a flange (313) configured to cover the opening portion of the bulb shell (2).

* * * * *